United States Patent [19]

Sakai et al.

[11] Patent Number: 4,504,411

[45] Date of Patent: Mar. 12, 1985

[54] RESISTOR COMPOSITION FOR RESISTOR-INCORPORATED SPARK PLUGS

[75] Inventors: Masao Sakai, Kasugai; Yasuhiko Suzuki, Aichi; Makoto Sugimoto, Nagoya, all of Japan

[73] Assignee: NGK Spark Plug Co., Ltd., Aichi, Japan

[21] Appl. No.: 514,327

[22] Filed: Jul. 15, 1983

[30] Foreign Application Priority Data

Jul. 21, 1982 [JP] Japan ..... 57-125732

[51] Int. Cl.[3] ..... H01B 1/06

[52] U.S. Cl. ..... 252/506; 252/507; 252/508; 252/509; 252/504; 252/510; 252/511; 338/20

[58] Field of Search ..... 252/506, 507, 509, 510, 252/504, 508, 511; 338/20; 315/58; 313/144, 136, 145

[56] References Cited

U.S. PATENT DOCUMENTS

| | | | |
|---|---|---|---|
| 3,408,524 | 10/1968 | Blum et al. | 252/512 X |
| 3,525,894 | 8/1970 | Blum | 252/512 X |
| 3,562,186 | 2/1971 | Kesten et al. | 313/136 |
| 3,562,187 | 2/1971 | Abdella | 313/144 |
| 3,909,459 | 9/1975 | Friese et al. | 252/509 |
| 4,001,145 | 1/1977 | Sakai et al. | 252/512 |
| 4,006,106 | 2/1977 | Yoshida et al. | 252/512 |
| 4,173,731 | 11/1979 | Takagi et al. | 252/506 |

*Primary Examiner*—Josephine L. Barr

*Attorney, Agent, or Firm*—Wegner & Bretschneider

[57] ABSTRACT

A resistor composition for a resistor-incorporated spark plug, composed of glass, an inorganic aggregate and carbon, and adapted to be sealed in a centerbore in a ceramic insulator, at least 1% by weight of said aggregate being in advance mixed and calcined with an organic carbonaceous material to adsorb resultant carbonized carbon.

7 Claims, 1 Drawing Figure

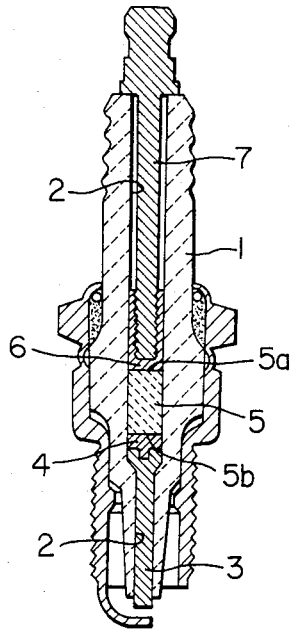
7
2
1
6
5a
5
4
5b
2
3

RESISTOR COMPOSITION FOR RESISTOR-INCORPORATED SPARK PLUGS

BACKGROUND OF THE INVENTION

The present invention relates to a resistor composition for resistor-incorporated spark plugs.

In the prior art, there is known a spark plug obtained by sealing a resistor of 0.5–20 KΩ in the centerbore of a refractory (ceramic) insulator between the inner end of an electrode rod (a center electrode) and the inner end of a terminal rod optionally by means of a conductive glass sealing agent, both rods being inserted through said centerbore, which is found to excel in the suppression of jamming radio waves generated by spark discharge.

The conventional compositions for such a spark plug generally comprise a base mixture composed of 30–70% by weight of glass frit with the remainder being an inorganic aggregate comprising alumina, zircon, mullite, silica, clay, silicon nitride, aluminium nitride or the like, or alternatively a mixture of two or more thereof, 0.1–10.0 parts by weight of a carbonaceous material (calculated on carbon after calcination) and 0–30 parts by weight of an agent for stabilizing resistance under load (hereinafter simply called the stabilizer) comprising one or more selected from the group consisting of the oxides and carbides of rare earth elements and metals of Subgroups IVa, Va and VIa of the periodic table as well as ZnO, $B_4C$, SiC, TiB and TiN.

It has been known to prepare such resistor compositions by mixing and calcining the glass and the inorganic aggregate with the so-called carbonaceous material producing carbon by calcination, and subsequently adding and mixing a binder to and with the resulting mixture. The stabilizer may be added before or after calcination. Known is also a process by which it is not necessary to calcine the glass, the inorganic aggregate and the carbonaceous substance prior to mixing in the binder and charging the mixture into the centerbore of the refractory insulator.

The resistor composition should be sealed in place with a given resistance value in order to prevent generation of any jamming of radio waves at the time of ignition of the spark plug. However, it has been found that both the aforesaid cases give rise to a variation in resistance value, and should rely upon strict sealing temperature control.

SUMMARY OF THE DISCLOSURE

It is an object of the present invention to provide a novel resistor composition for resistor-incorporated spark plugs which can eliminate the drawbacks in the prior art.

It is another object of the present invention to provide a novel resistor composition for resistor incorporated spark plugs which can be prepared with ease.

Other objects will become apparent from the entire disclosure.

In an effort to eliminate such a variation in the resistance value of the resistor after sealing, it has been found that in the former case, the resistance value varies largely depending upon the glass sealing temperature due to the fact that the glass reacts with the aggregate during the calcination to form a resistor material having a higher softening point, whereas in the latter case without recourse to any calcination step, the resistance value also varies largely as well, since the organic carbonaceous material is in this case carbonized by heating for sealing.

In accordance with the present invention underlain by such findings, an organic carbonaceous material is mixed beforehand with a part (at least 1% by weight) of the aggregate to be used followed by calcination, whereby the aggregate adsorbs thereon the resultant carbonized carbon. To the calcined aggregate are added glass frit, the remainder, if any, of the aggregate and an organic carbonaceous material serving as a binder to obtain a resistor composition. To insert the resistor composition into a centerbore, it is previously granulated or formed under pressure.

In what follows, the present invention will be explained in detail with reference to a single FIGURE showing the section of a resistor-incorporated spark plug wherein the resistor composition according to the present invention is sealed.

DESCRIPTION OF PREFERRED EMBODIMENTS

The glass frit contained in the resistor composition according to the present invention serves as a binder and, for that purpose, use may be made of, for instance, borosilicate glass, barium borate-base glass, lead glass or the like glass. In particular, it is found that BaO-containing glass shows good compatibility or wettability with respect to carbonaceous materials. Preference is then given to glasses having a softening point of higher than 300° C. Too low a softening point poses some problems. For example, when practically used with an engine, it is difficult to secure the center electrode and the terminal rod in place with the resistance value fluctuating. The glasses used in the present invention are prepared in the known manner, pulverized to a suitable particle size and fritted for use.

The inorganic aggregates include oxides, silicate minerals, etc., either crystalline or non-crystalline, which are usually used as ceramic raw materials such as, for instance, alumina, zircon, mullite, fused silica, magnesia, silica and clay, and encompass electrically poorly conductive, heat-resistant substances. In addition to the substances hereinabove mentioned, the aggregates should contain preferably at least one of a nitride such as, for instance, silicon nitride, boron nitride and aluminium nitride.

These inorganic aggregates are added to the resistor body with a view to providing heat resistance thereto and preventing its end surfaces from being sphered. In particular, the addition of the nitrides in an amount of 0.1% by weight or more is effective in further improving the noise suppresion effect.

As the aggregates to be subjected to calcination, use should preferably be made of substances that undergo neither deterioration nor degradation at a temperature on the order of which organic carbonaceous substances are carbonized, and can adsorb and retain thereon carbonized carbon as much as possible, such as clay, mullite, molten silica, silica, etc. These materials tend to retain thereon carbon as much as possible upon calcination, when used as the aggregates for calcination. However, dense aggregates such as $Al_2O_3$, $Si_3N_4$, etc. should be used in a larger amount for calcination, since they poorly absorb carbon and, hence, retain thereon lesser amounts of carbon after calcination.

According to the present invention, the base mixture (glass plus inorganic aggregate) in the overall inorganic ingredients contains 30 up to 70% by weight of glass. If the glass content is below 30% by weight, insufficient bonding takes place among the aggregate particles so that the resulting resistor is too porous, adversely affecting its airtightness and service life under load. Besides, one may encounter difficulties in insertion of the terminal rod (a male screw) and in bonding of the resistor composition to the inner wall of the insulator centerbore.

On the other hand, if the glass content exceeds 70% by weight, the glass may enter voids among the carbon particles serving as a conductive material with the result that the resistance value increases and varies largely. In addition, the interfacial planes between the resistor body 5 and conductive sealing glass become not at a right angle with respect to the longitudinal axis of the insulator centerbore 2 during the hot-pressing thereof, wherein the upper and lower interfaces or end faces *5a* and *5b* of the resistor body are sphered, resulting in an effective length l being shorter than a given design length l'. This renders it difficult to obtain the desired resistance, and leads to deterioration in the desired noise suppression effect.

In most cases, the organic carbonaceous substances carbonized and absorbed onto the aggregate by calcination are those serving as a binder at the granulation step of a resistor material (for instance, methyl cellulose, gum arabic, PVA, etc,). Thus, it is significant to add a part of the carbonaceous material after calcination. Besides, CMC, glycerol, dextrin, succrose, lactose, maltose, glucose, xylose or the like may be employed. These organic carbonaceous materials are optionally diluted with water or other solvent.

Preferably, the amount of the organic carbonaceous material calcined is reduced as much as possible, since the calcination step is then simplified. For instance, clay and glycerol are mixed together in a proportion of 1:1, and calcined at a temperature of 700° C. In mixing with the base mixture (glass plus inorganic aggregate), the thus calcined product is employed in an amount of 15 parts by weight per 100 parts by weight of the base mixture. Thus, satisfactory results are as a whole obtained if the organic carbonaceous material is mixed with a part of the aggregate followed by calcination, and the resultant calcined aggregate is mixed with the remaining part of the aggregate.

Per 100 parts by weight of the base mixture, the carbon deriving from calcination preferably amount to at least 0.1 part by weight or higher, particularly 0.5 to 3 parts by weight, (calculated as carbon) for realizing the effect of the present invention.

With clay as the aggregate for calcination, it can be used in an amount of up to about one part by weight per one part by weight of the organic carbonaceous material. This upper limit is mainly dependent upon the nature or state of the mixture during calcination. For example, a slurried mixture is difficult to calcine. It is advantageous that the resistor composition having a carbon content suitable for the desired purpose can be obtained by mixing the calcined aggregate, having an appropriate amount of the carbon derived from calcination deposited thereon with a non-calcined aggregate.

Other organic carboneceous materials used as a binder include paraffin wax or other known organic binders capable of being carbonized during calcination or sealing (heating in an oxygen poor atmosphere), in addition to water-soluble substances.

Referring to FIG. 1, there is shown a resistor-incorporated spark plug under test used in the examples given later.

A center electrode 3 is inserted through a centerbore 2 in a porcelain insulator 1, and thereon the centerbore 2 is charged with a conductive glass powder 4. On the glass powder 4 are further charged with a resistor composition 5 and another conductive glass powders 6. After the conductive glasses 4 and 6 as well as the resistor composition 5 have been put in a softened state by heating the insulator 1 to a given temperature, a terminal rod 7 is inserted applying pressure into the centerbore 2, and sealed to form an integral spark plug arrangement.

EXAMPLE 1

Glass compositions as mentioned in Table 1 were prepared in advance, and finely pulverized to obtain glass frits A, B and C by sieving-out through to JIS 150 mesh.

TABLE 1

| glass | PbO | $SiO_2$ | $B_2O_3$ | BaO | ZnO |
|---|---|---|---|---|---|
| A | 60 | 25 | 15 | | |
| B | | 5 | 60 | 35 | |
| C | | 38 | 26 | 16 | 20 |

Apart from the preparation of the aforesaid glass frits, the aggregates and organic carbonaceous materials as given in Table 2 were kneaded together. After being embedded in graphite, the resulting mixtures were calcined in an oxygen poor atmosphere, finely pulverized and sieved out through a JIS 150 mesh to obtain calcined aggregates D-I.

TABLE 2

| calcined aggregates | compositions (wt parts) | | calcining temperature | carbon after calcined (wt %) |
|---|---|---|---|---|
| D | clay | 2 | 700° C. × 2 Hr | 13 |
| | glycerine | 1 | | |
| E | clay | 5 | 700° C. × 2 Hr | 7 |
| | glycerine | 1 | | |
| F | clay | 2 | 500° C. × 2 Hr | 15 |
| | glycerine | 1 | | |
| G | clay | 4 | 1200° C. × 2 Hr | 5 |
| | glycerine | 3 | | |
| H | clay | 10 | 700° C. × 2 Hr | 13 |
| | gum arabic | 1 | | |
| I | clay | 1 | 700° C. × 2 Hr | 13 |
| | $Si_3N_4$ | 1 | | |
| | glycerine | 1 | | |

In the proportions as stated in Table 2, the glasses, calcined aggregates, non-calcined aggregates and organic carbonaceous materials were dry-mixed together for 3 hours in a ball mill to obtain resistor composition (material) samples Nos. 2–15.

The organic carbonaceous materials were added so as to keep the resistance value upon hot-pressing within a given range and to serve as binders. In samples Nos. 2–8 and 11–15, methyl cellulose was used as the organic carbonaceous material. In samples Nos. 9 and 10, gum arabic and glycerol were used, respectively. 0.5 grams of the resistor composition (material) were charged together with upper and lower glass sealing agents of each weighing 0.2 grams as shown in FIG. 1 (showing a finished plug), and axially hot-pressed at 950° C. for 5 minutes to seal the resistor in the plug. From each sample composition 50 spark plugs for test were made, of which the resistance values upon sealing were measured to determine the dispersion thereof or the resistors. The dispersion in resistance values as set forth in Table 3 were calculated from $s=\sigma/\chi\times100$ (%) wherein $\sigma$ is the standard deviation and $\chi$ is the mean resistance value.

EXAMPLE 2

To stabilize the service life under load of the spark plugs, TiO and TiC were respectively added to the compositions obtained in Example 1 to obtain samples Nos. 17 and 18. The conditions for the preparation, hot-pressing, etc. of the samples were all identical with those used in Example 1. Likewise, the samples were measured on their dispersions in resistance values. As will be appreciated from Table 3, the addition of $TiO_2$ and TiC resulted in less dispersions in resistance values.

COMPARATIVE EXAMPLE

A sample R1 of Table 3 without any calcined matter was hot-pressed under the same conditions as applied in Example 1. As will be noted from Table 3, a dispersion of resistance value was larger than in Examples 1 and 2.

TABLE 3

| sample No. | | glass | aggregates | | calcined aggregates | | carbonaceous material from binder | | agent for stabilizing resistance under load | | dispersion of R value $\sigma/\kappa\times100$ (%) |
|---|---|---|---|---|---|---|---|---|---|---|---|
| R | 1 | A 60 | $Si_3N_4$ | 40 | D | 0* | methylcellulose | 3.0 | | 0 | 17.2 |
| | 2 | " | " | 39.6 | " | 0.4 | | 2.8 | | 0 | 12.2 |
| | 3 | " | " | 39 | " | 1 | | 2.5 | | 0 | 12.0 |
| | 4 | " | " | 25 | " | 15 | | 0.5 | | 0 | 5.8 |
| | 5 | B 60 | " | 25 | " | 15 | | 0.5 | | 0 | 6.9 |
| | 6 | C 60 | " | 25 | " | 15 | | 0.5 | | 0 | 8.0 |
| | 7 | A 60 | clay | 25 | " | 15 | | 0.5 | | 0 | 8.9 |
| | 8 | " | zircon | 25 | " | 15 | | 0.5 | | 0 | 9.0 |
| | 9 | " | $Si_3N_4$ | 12.5 | " | 15 | | 0.5 | | 0 | 7.5 |
| | | | fused silica | 12.5 | | | | | | | |
| | 10 | " | $Si_3N_4$ | 25 | " | 15 | gum arabic | 0.8 | | 0 | 6.3 |
| | 11 | " | " | 25 | " | 15 | glycerine | 20 | | 0 | 9.5 |
| | 12 | " | | 0 | E | 40 | | 0 | | 0 | 8.1 |
| | 13 | " | $Si_3N_4$ | 25 | F | 15 | methylcellulose | 0.3 | | 0 | 9.5 |
| | 14 | " | $Si_3N_4$ | 25 | G | 15 | " | 0.8 | | 0 | 7.3 |
| | 15 | " | " | 25 | H | 15 | " | 0.8 | | 0 | 8.8 |
| | 16 | " | " | 25 | I | 15 | " | 0.5 | | 0 | 9.1 |
| | 17 | " | " | 25 | D | 15 | " | 0.5 | $TiO_2$ | 5 | 6.0 |
| | 18 | " | " | 25 | " | 15 | " | 0.5 | TiC | 3 | 6.0 |

*wt parts without carbon

A comparison of the dispersions in the resistance values given in Table 3 indicates that the resistor compositions of the present invention have a dispersion in resistance value reduced to about half of that of the conventional compositions.

What is claimed is:

1. A resistor composition for a resistor-incorporated spark plug, adapted to be sealed in a centerbore of a ceramic insulator, comprising 100 parts by weight of a base mixture of 30–70% by weight of glass and the remainder being an inorganic aggregate comprising alumina, zircon, mullite, silica, fused silica, magnesia, clay, silicon nitride, aluminum nitrides, boron nitride or mixtures thereof;

0.1–10 parts per weight, calculated as carbon on calcination, of an organic carbonaceous material; and 0–30 parts by weight of an agent for stabilizing resistance under load consisting of one or more selected from the group consisting of oxides and rare earth elements and metals from subgroups IVa, Va and VIa of the periodic table, ZnO, $B_4C$, SiC, TiB and TiN, wherein 1–100% by weight of said aggregate is mixed with the organic carbonaceous material and calcined prior to mixture with the glass and the remaining ingredients of the resistor composition to absorb the resultant carbonized carbon onto the calcined aggregate.

2. A resistor composition as defined in claim 1, comprising 100 parts by weight of a base mixture of 30–70% by weight of glass with the remainder being an inorganic aggregate, 0.1–10.0 parts by weight—calculated on carbon after calcination—of an organic carbonaceous material, and 0–30 parts by weight of an agent for stabilizing resistance under load.

3. A resistor composition as defined in claim 1, wherein said aggregate comprises alumina, zircon, mullite, silica, fused silica, magnesia, clay, silicon nitride, aluminium nitride or boron nitride, or a mixture of two or more thereof.

4. A resistor composition as defined in claim 1, wherein said agent for stabilizing resistance under load consists of one or more components selected from the group consisting of the oxides and carbides of rare earth elements and metals of Subgroups IVa, Va and VIa of the periodic table, ZnO, $B_4C$, SiC, TiB and TiN.

5. A resistor composition as defined in claim 1, to which an organic carbonaceous material serving as a binder is added in an amount of 0–9.9 parts by weight—calculated on carbon—per 100 parts by weight of said base mixture.

6. A resistor composition as defined in claim 1, wherein the calcination temperature is 500°–1200° C.

7. A resistor composition as defined in claim 1, which contains 0.1–10 parts by weight of carbon deriving from carbonization by calcination per 100 parts by weight of said base mixture.

* * * * *